US005249610A

United States Patent [19]

Cassou et al.

[11] Patent Number: 5,249,610

[45] Date of Patent: Oct. 5, 1993

[54] SINGLE-USE INJECTOR NOZZLE FOR STRAW FILLING MACHINE, IN PARTICULAR FOR ARTIFICIAL INSEMINATION OF ANIMALS AND STORAGE OF BIOLOGICAL PRODUCTS

[76] Inventors: Robert Cassou, 18700 Aubigny S/Nere; Maurice Cassou; Bertrand Cassou, both of 10 rue Georges Clémenceau, 61300 l'Aigle, all of France

[21] Appl. No.: 925,865

[22] Filed: Aug. 7, 1992

[30] Foreign Application Priority Data

Aug. 7, 1991 [FR] France ..... 91 10032

[51] Int. Cl.[5] ..... B65B 43/42; B67C 3/00

[52] U.S. Cl. ..... 141/130; 141/329; 141/382; 141/312; 285/256; 119/174; 604/412; 604/905

[58] Field of Search ..... 141/329, 382, 312, 130; 285/256; 239/600; 119/174; 604/272, 280, 283, 264, 403, 408, 411-416, 905, 906

[56] References Cited

U.S. PATENT DOCUMENTS 2,716,982 9/1955 Ryan ..... 604/412
2,915,062 12/1959 Butler et al. ..... 604/412
4,723,948 2/1988 Clark et al. ..... 604/905

FOREIGN PATENT DOCUMENTS 995878 12/1951 France .
2651793 3/1991 France .

*Primary Examiner*—Henry J. Recla
*Assistant Examiner*—Steven O. Douglas
*Attorney, Agent, or Firm*—Young & Thompson

[57] ABSTRACT

Straws, in particular for artificial insemination of animals and storage of biological products, are filled by aspiration through a suction nozzle fitted with a needle which enters the straw to the rear of a composite stopper and is fitted with a seal. A biological product (diluted sperm) is drawn up a flexible elastomer tube to an injector nozzle in response to reducing the pressure in the straw. The flexible tube is held centered over a distance equal to at least five times its outside diameter in a hoop held in a support. The elastomer from which the flexible tube is made has a Shore hardness of 41 to 47 and a reversible elongation capacity of at least 250%. These arrangements ensure rigorous centering of the needle in the hoop despite the flexibility of the tube. Parts which have been in contact with the sperm can be discarded after all of a sample has been used up, rather than requiring costly cleaning.

13 Claims, 1 Drawing Sheet

FIG 1
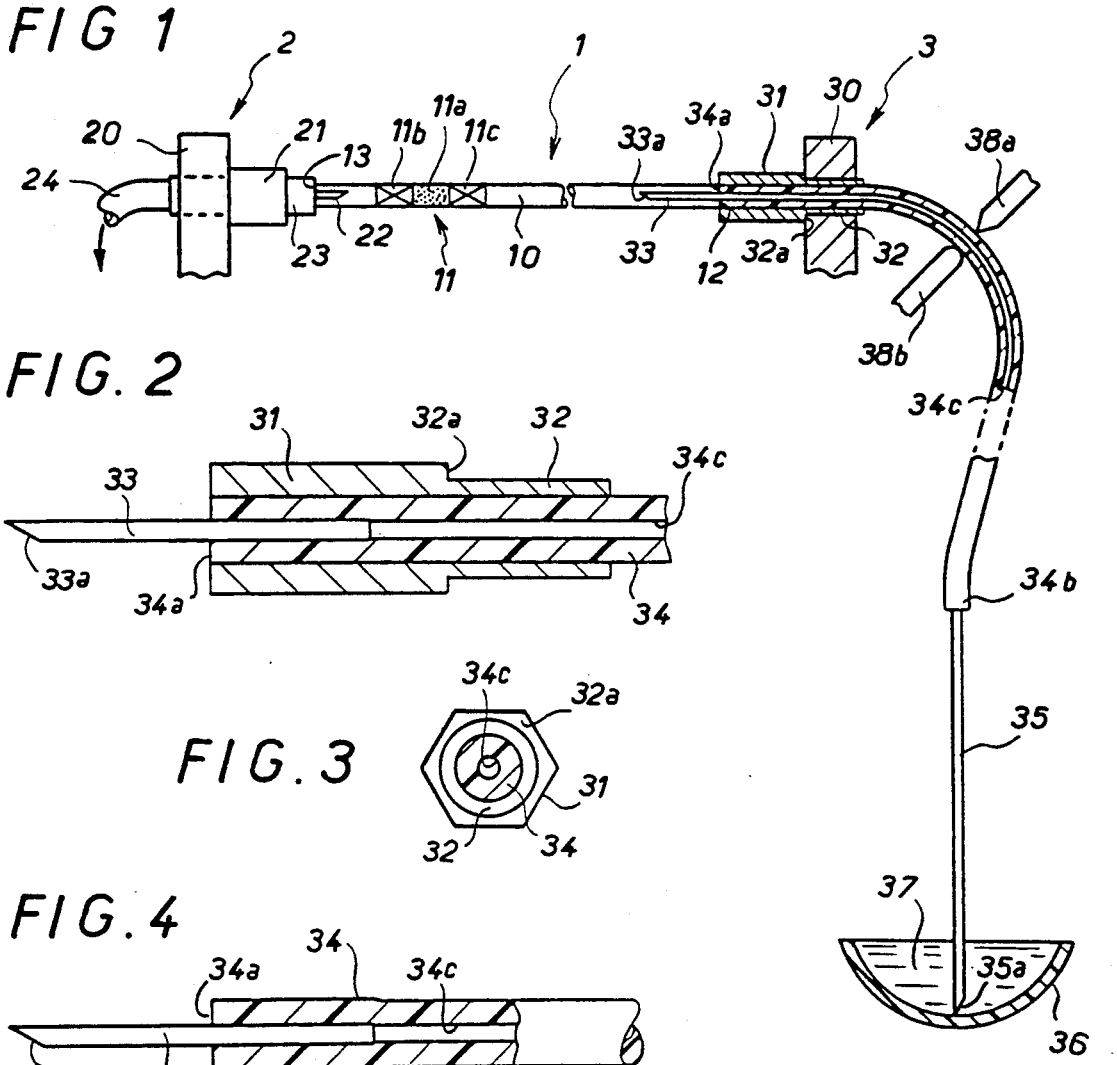
FIG. 2
FIG. 3
FIG. 4
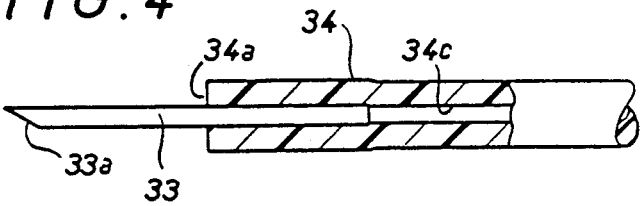
FIG. 5
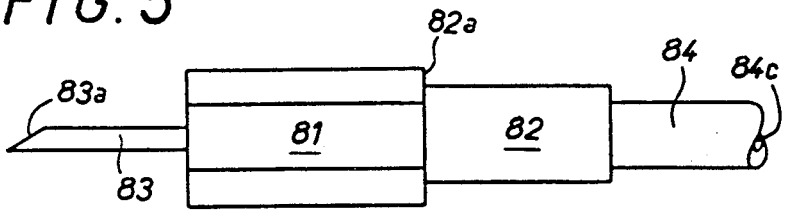
FIG. 6
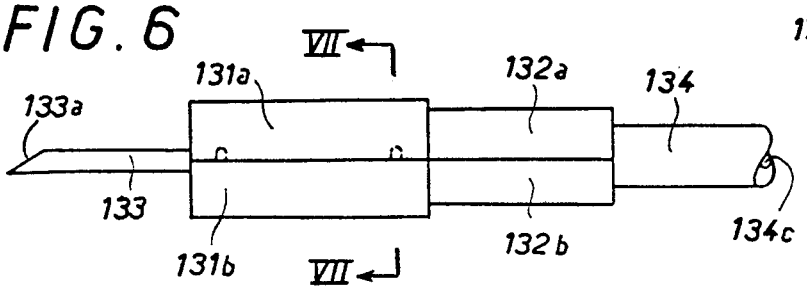
FIG. 7
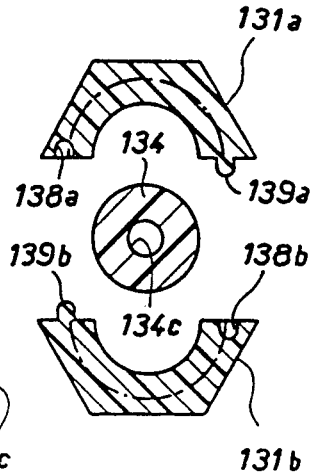

SINGLE-USE INJECTOR NOZZLE FOR STRAW FILLING MACHINE, IN PARTICULAR FOR ARTIFICIAL INSEMINATION OF ANIMALS AND STORAGE OF BIOLOGICAL PRODUCTS

BACKGROUND OF THE INVENTION

1. Field of the Invention

The invention concerns a single-use injector nozzle for machines for filling with biological products tubes usually called straws in the form of tubular sections of polymer material with a diameter of a few millimeters provided internally near one end with a composite stopper comprising, between two porous plugs, a volume of powder which gelifies in contact with an aqueous liquid, filling being effected by gripping the straws between two nozzles fitted with seals bearing on the ends, namely a suction nozzle connected to a vacuum pump and bearing on the end of the straw near the composite stopper and the injector nozzle fitted with a flexible tube which dips into a flask containing the biological product, the injector nozzle comprising a rigid tube referred to hereinafter as a needle adapted to be inserted into the straw and crimped axially in a body which has two external reference surfaces for respectively centering and longitudinally positioning the nozzle relative to a nozzle support.

2. Description of the Prior Art

The tubes known as straws referred to above have been extensively described in the art since the document FR-A-995 878 of 20 Sep. 1949. Their use has expanded considerably since that time, in parallel with the growth in artificial insemination of animals, especially cattle.

The present description will make particular reference to the insemination of cattle, which has been widely adapted since it was first introduced and may be regarded as typical, although artificial insemination is practised on horses, sheep, pigs, rabbits, poultry and in fish farming (this list is not exhaustive).

There are two fundamental requirements in respect of filling the straws: a) it must be carried out under the aseptic conditions that are the norm in veterinary practise and which enable certain identification of the donor animal, and b) the operations must be suited to large-scale use. In the latter regard, to give a clear idea of the orders of magnitude involved, one dose of bull semen fills approximately 800 straws and an artificial insemination center can process up to 60 bulls each day.

There is no need to dwell upon the process of collecting, checking the quality of and diluting the sperm: note that the receptacle or flask in which the sperm is collected contains sufficient to fill a batch of straws (up to 800 of them), which have an individual capacity of around 0.5 $cm^3$.

The process of filling the straws by sucking dilute sperm through the flexible tube, the injector nozzle and the straw body by depressurizing the system through the suction nozzle and the composite stopper is outlined above. The composite stopper remains permeable to air while the powder contained between the two porous plugs has not gelified through contact with an aqueous liquid, in the present instance the liquid with which the sperm is diluted. When the straw is filled the composite stopper closes off the end of the straw.

On the machine the straws are placed in a hopper from which a dispenser inserts them into equi-distant calibrated notches on a conveyor belt with the straws perpendicular to the direction of movement of the belt.

The belt is advanced stepwise by an amount representing one or three notches, depending on the required throughput. At a first workstation nozzles are disposed on supports which can move to and from transversely to the belt, the number of suction and injector nozzles being equal to the number of notches per stepwise movement of the belt. The supports move apart to release the straws and move towards each other to achieve sealed contact between the nozzles and the ends of the straws. The document FR-A-2 651 793 provides pertinent information on this filling process.

Note that at present the highest performing machines can achieve a rate of 72 cycles per minute with three straws filled simultaneously in each cycle, i.e. 216 straws/minute.

At a second workstation on the output side of the first end of each straw opposite the composite stopper is closed by crushing and welding it ultrasonically between an anvil and an ultrasound generator.

Note that reliable execution of the weld requires that over at least the length to be welded the straw does not contain any liquid. For this reason the injector needle must be long enough for the aspirated liquid to leave the needle and come into contact with the wall of the straw beyond the area to be welded. As the outside diameter of the needle is only slightly less than the inside diameter of the straw, it will be understood that the needle must be accurately coaxial with the straw, that the travel over which the nozzle supports move towards each other must be accurately controlled for the nozzles to be sealed to the ends of the straw without loading the straw in buckling mode which is hazardous to its integrity, and that all this must be achieved at the required rates of throughput.

The accuracy required has led the man skilled in the art to design the nozzles as precision mechanical components with a needle crimped rigidly into a metal body which has two reference surfaces for fitting it into the nozzle support, namely an axial centering surface, usually a cylindrical bearing surface, and a longitudinal positioning surface, usually a flat edge machined straight where the cylindrical bearing surface and a front holding part meet. The seal is provided by a cylindrical elastomer plug with a central hole through which the needle slides, being a snug fit, the plug abutting the forward edge of the body.

The suction nozzles do not represent any problem; the needle can be short; what is more, the suction nozzles do not come into contact with aseptic parts of the straw because of the isolation provided by the composite stopper; being at a lower pressure than the straw, there is no risk that they will inject pollutants into the straw. Simple daily maintenance and thorough weekly cleaning are sufficient.

The situation is totally different in respect of the injector nozzles, however. These, together with their flexible tube, must be strictly clean and dry on starting to fill straws with the sperm of a given donor animal and must be removed when all of the semen has been used and replaced with sterile nozzles for filling a new batch of straws with sperm from another donor.

To return to the previous example and to give an idea of the orders of magnitude involved, with 60 bulls per day and three injector nozzles per machine, no less than 180 nozzles are used each day. After use the flexible tubes are pulled off the nozzle spigots and discarded. The nozzles are placed in alcohol. At the end of each day the nozzles are carefully cleaned, fitted with new flexible tubes and sterilized for re-use the following day. This presupposes a large rotating stock of injector nozzles and time-consuming operations which must be carefully checked and still represent a risk of a nozzle containing traces of sperm from a previous animal.

In fact the operations involved in the daily preparation of the injector nozzles account for practically as much labor time as the filling operations themselves.

For a long time it has been realized that it would be beneficial to have injector nozzles fitted with a flexible tube to be dipped into the flask of semen that could be discarded after a single-use, that is to say after filling a batch of straws with dilute sperm from a single donor.

However, the mechanical precision required of the nozzles, as explained above, indicated a prohibitive unit cost, so that users have deemed it more cost-effective to continue in their previous ways than to discard the used nozzles.

With considerable experience in this art, we have undertaken to review all aspects of the problem of single-use injector nozzles.

SUMMARY OF THE INVENTION

The invention consists in a single-use injector nozzle for machines for filling with biological products tubes usually called straws in the form of tubular sections of polymer material with a diameter of a few millimeters provided internally near one end with a composite stopper comprising between two porous plugs a volume of powder which gelifies in contact with an aqueous liquid, filling being effected by gripping the straws between two nozzles fitted with seals bearing on the ends of the straw, namely a suction nozzle connected to a vacuum source and bearing on the end of the straw near the composite stopper and said injector nozzle fitted with a flexible tube which dips into a flask containing the biological product, said injector nozzle comprising a rigid needle adapted to be inserted into said straw and crimped axially in a body which has two external reference surfaces for respectively centering and longitudinally positioning said nozzle relative to a nozzle support, said flexible tube being made from an elastomer having a Shore hardness between 41 and 47 and a reversible elongation capacity of at least 250%, having an inside diameter of the same order of magnitude of the outside diameter of said needle and a nominal outside diameter at least twice said inside diameter, a right cross-section at the end into which said needle is inserted to a length of at least five times its outside diameter forming a seal bearing surface for the end of said straw remote from said composite stopper, and said flexible tube being gripped, at least when said nozzle is mounted on said machine, over a distance equal to at least five times its nominal outside diameter starting from the right cross-section at said end in a tubular hoop of rigid material whose inside diameter is matched to the nominal outside diameter of the tube with sufficient clamping force to hold and seal said needle, said hoop comprising said two reference surfaces.

By virtue of these arrangements the end of the flexible tube constitutes a seal bearing surface for the filling end of the straw. In this way the surfaces in contact with the dilute sperm are reduced to the interior of the flexible tube and the needle. This can be shortened by the length of the conventional seal and so reduce the tip positioning error resulting from the needle not being accurately coaxial with the body.

It might seem at first sight that inserting the needle into the interior passage of an extremely flexible elastomer tube could not achieve the necessary precision as to the position and orientation of the needle, given the flexibility of the tube, and that using the right cross-section at the end of the tube as a seal bearing surface could not seal the joint in the absence of positive retention of the tube against the thrust from the straw end. We have found that it is possible to center the needle in a tubular hoop with mechanical engineering grade accuracy provided that the material from which the flexible tube is made has a virtually perfect elastomer behavior (i.e. reversible deformation without variation in volume creating tensions normal to the deformation surfaces), that the stresses produced in the wall by forces applied to the limiting surfaces of the tube are circumferentially distributed around the axis of the internal passage, that the tube wall thickness is sufficient to regularize this distribution, that the needle is inserted into the interior passage to at least five times its outside diameter, that the hoop extends over a distance of at least five times the outside diameter of the tube and that no asymmetrical forces are induced.

Furthermore, because of the mode of deformation of the elastomer constituting the tube, any external force tending to depress a surface of the tube results in a tendency for adjacent parts to expand. The bearing contact between the end of the straw and the right cross-section at the end of the tube tends to force the outside surface of the tube wall onto the hoop and the surface of the interior channel onto the needle, retrograde movement of the tube in the hoop being prevented by friction between the elastomer and the hoop, which is directly proportional to radial expansion of the tube. The seal bearing surface has an excellent reversible elastic character.

Note that because the outside diameter of the needle is virtually the same as the inside diameter of the tube, in the absence of the hoop, insertion of the needle is easy.

The needle preferably projects from the right cross-section at the end of the flexible tube by an amount sufficient to provide at the end of the straw where the needle enters an area that is not filled and which is available for closing the straw and welding the wall. There remains between the liquid in the straw and the weld a bubble of air which acts as a plug to prevent the straw breaking during freezing and thawing of the content of the straw, which is usually stored in liquid nitrogen.

At the end away from the flexible tube the needle preferably has a bevelled end which facilitates its insertion into the straw.

The outside diameter of the needle is preferably around 2.0 or 1.4 mm, depending on whether the straws are of the so-called standard kind with an outside diameter of 3 mm or of the fine kind with an outside diameter 2 mm.

The nominal (i.e. unstressed) outside diameter of the flexible tube is preferably 4.5 mm.

The preferred elastomer is a biologically compatible styrene and butadiene block copolymer.

The preferred material of the needle is a polyester copolymer known as PETG.

At the end remote from the needle the flexible tube preferably comprises a section of rigid tube inserted into the interior passage at one end, the other end being bevelled. This arrangement, known in itself, makes it possible to draw up all of the dilute semen contained in the flask.

The hoop is preferably permanently disposed on the flexible tube. In this case it may be molded from a polymer material and either overmolded in place or installed by fitting together two half-shells which meet in a plane passing through its axis.

Subsidiary features and advantages of the invention will emerge from the following description given by way of example with reference to the appended drawings.

BRIEF DESCRIPTION OF THE DRAWINGS

FIG. 1 is a diagram showing a straw filling station equipped with an injector nozzle in accordance with the invention.

FIG. 2 is a view of the injector nozzle in cross-section.

FIG. 3 is a rear view of the nozzle from FIG. 2.

FIG. 4 is a view analogous to that of FIG. 2 but with the hoop removed.

FIG. 5 is a side view of a nozzle permanently fitted with a hoop.

FIG. 6 is a view analogous to that of FIG. 5 showing a hoop comprising two members bonded together.

FIG. 7 is an exploded view in cross-section on the line VII—VII in FIG. 6.

DETAILED DESCRIPTION OF THE INVENTION

In the embodiment shown in FIG. 1 a straw 1 has been placed in a filling station of an automatic machine for filling straws with dilute animal sperm. In the usual way the straw 1 comprises a section about 130 mm long and with an outside diameter of 3 mm and a wall thickness of approximately 1.2 mm of transparent thermoplastic polymer material (this is a so-called standard straw with a usable capacity of 0.5 $cm^3$). The straw 1 is filled from a first end 12. It comprises internally and near the opposite end 13 a composite stopper 16 formed in the conventional way of a cylinder 11*a* of powder adapted to gelify in contact with an aqueous liquid trapped between two porous plugs 11*b* and 11*c*. To fill it the straw 1 is fitted between a suction nozzle 2 and an injector nozzle 3 mounted on respective nozzle supports 20 and 30 movable parallel to the length of the straw 1 to release the latter on moving away from each other after filling and to make sealed contact with the ends 12 and 13 at sealing bearing surfaces 34*a* and 23 on moving towards each other.

The suction nozzle 2 is conventional and comprises a body of revolution 21 through which runs a central bore and to which is axially crimped a needle 22 in the form of a thin tube of stainless steel with a bevel cut at one end. This enters the tube 10 of the straw 1 axially at the same end as the composite stopper 11. A seal 23 in the form of a section of thick-walled elastomer tube is forced over the needle 22 until it bears against the front edge of the body 21. At the rear the body 21 is formed as a spigot over which is fitted an elastomer tube 24 connected to a vacuum pump. The tube 24 is gripped between two jaws (not shown) which can be clamped together to crush the tube 24 and so function as a valve.

The injector nozzle 3 is held in a nozzle support 30 which is able to reciprocate as already mentioned.

FIGS. 2 and 3 show the nozzle 3 in detail. The nozzle comprises a needle 33 gripped in an extruded tube of PETG polyester copolymer marketed by Eastman under the name KODAR PETG 6763 with an outside diameter of 1.7 mm and a wall thickness of 0.1 mm. The needle has bevel cut 33*a* at its free end and a total length of 25 mm. It is inserted to a length of 10 mm into a flexible elastomer tube 34 which has an inside diameter 34*a* of approximately 1.8 mm and a nominal outside diameter of 4.5 mm. The expression nominal outside diameter is to be understood as meaning the outside diameter of the tube when it is not deformed by external forces.

This elastomer is a styrene and butadiene block copolymer with a Shore hardness of 44 and capable of reversible elongation of at least 250%.

This polymer is marketed under the trade name Kraton by the Polymer Division of the Shell Chemical Company. It is intended for pharmaceutical, medical and foodstuffs packaging applications.

The flexible tube 34 is inserted into a hoop 31, 32 whose inside diameter is less than the nominal diameter of the tube 34 by an amount such that the needle 33 is gripped and sealed. For example, with a flexible tube 34 having a nominal diameter of 4.5 mm, an interior diameter 34*c*' of 1.8 mm and a needle outside diameter of 2.0 mm, the inside diameter of the hoop will be 4.0 mm. The hoop has a first, front part 31 of hexagonal outside shape extending towards the front (the needle 33 end) flush with the right cross-section 34*a* at the end of the tube 34 which forms a seal bearing surface for the end 12 of the straw 1 (this hexagonal shape has been adopted to facilitate handling and manipulation but is not essential). The rear part 32 has a cylindrical outside surface which serves as a reference for centering the needle relative to the support 30 and therefore relative to the tube 10 of the straw. The rear part 32 is joined to the front part 31 by a plane radial shoulder 32*a* which forms a reference surface for positioning it longitudinally abutted against the front surface of the support 30.

Beyond the rear part 32 of the hoop the tube 34 passes between jaws 38*a* and 38*b* provided for closing off the interior passage 34*c* of the tube 34 by crushing the wall when the jaws are moved together and so functioning as a valve.

Inserted into the end 34*b* of the flexible tube 34 remote from the needle is a section of rigid tube 35 of the same kind as the tube 10 of the straw 1. Its free end 35*a* is bevel cut and dips into a biological product, in this instance dilute bull sperm 17 contained in a flask 36. The use of a rigid tube 35 enables the end 35*a* to rest on the bottom of the flask so as to aspirate all of its content.

To fill a straw 1 held with its ends 12, 13 sealed to the seal bearing surfaces 34*a* and 23 the suction nozzle 22 is connected to the vacuum pump through the uncrushed elastomer tube 24. The suction is applied through the needle 22, the composite stopper 11 (the powder 11*a* of which is not gelified), the tube 10 of the straw, the needle 33, the interior passage 34*c* of the flexible tube 34 (the jaws 38*a* and 38*b* being moved apart) and the section of rigid tube 35. The dilute sperm 37 rises up the interior passage 34*c* of the flexible tube 34 until its spurts from the bevelled end 33*a* of the needle 33 to fill the straw 1. When the dilute sperm reaches the composite stopper 11 it passes through the porous plug 11*c* to moisten the powder 11*a* which gelifies and becomes impermeable. When the straw has been filled the tube 24 and the flexible tube 34 are closed off by clamping the valve jaws (38*a*, 38*b* for the tube 34) and the supports 20 and 30 are moved apart to release the straw 1 which is transferred to a welding station. There its end part near its end 12 that has not been filled because of the length to which the needle 33 penetrates into the straw 1 is gripped between the anvil and the ultrasound generator of an ultrasonic welding unit.

It will be understood that although the clearance between the inside of the straw 1 and the needle 33 is very small and the projecting length of the needle 33 is relatively large, to leave an unfilled area for welding, the needle 33 and the hoop 31, 32 can be held precisely coaxial despite the intrinsic flexibility of the flexible tube 34. This is because the elastomer between the needle 33 and the hoop 31, 32 (which does not change volume when it is deformed) can deform only in axial shear, strictly circumferentially. This is true only if the effects of longitudinal transitions can be neglected, which requires axial lengths that are large in comparison with the diameters. The ratio of five between the length and the diameter is representative of the transition between long and short insertions and hoops.

When all of the dilute sperm from a particular donor has been packaged in straws everything that has come into contact with the sperm must be removed and (in accordance with the invention) discarded because the objective is to eliminate all cleaning and sterilization of parts likely to retain any traces of sperm.

Unlike the prior art injector nozzle bodies, the hoop 31, 32 has not come into contact with the sperm. It is therefore possible to employ reusable hoops and to discard, as indicated in FIG. 4, only the flexible tube 34 with its needle 33, a sterile needle 33/tube 34 combination being inserted into a reusable hoop.

However, given that hoops can be manufactured at low cost, it would seem preferable to constitute a complete nozzle from the outset and to discard everything after a single use.

As shown in FIG. 5, in which the reference numbers of the relevant parts are increased by 50, the nozzle constitutes a monobloc assembly comprising the needle, the flexible tube 84 and a hoop 81, 82 clamped to the flexible tube 84, for example by overmolding with a two-component resin.

It is equally possible, as shown in FIGS. 6 and 7 in which the reference numbers of the relevant parts have been increased by 100, to injection mold shells 131*a*, 132*a* and 131*b*, 132*b* of identical shape adapted to fit together on a plane passing through the axis of the hoop. Housings 138*a* 138*b* are formed in the parts 131*a* and 131*b* with complementary pegs 139*a*, 139*b* to ensure axial and longitudinal coincidence of the shells. As shown in FIG. 7 the flexible tube 134 is trapped between the shells 131*a*, 132*a* and 131*b*. 132*b* whose facing surfaces have been coated with adhesive, for example a cyanoacrylate adhesive.

It will be understood that the complete nozzles made in this way can be fabricated at low cost, supplied ready for use in sterile packaging and discarded after use at low cost, even without allowing for the saving in respect of the time taken to clean the prior art injector nozzles.

Of course, the invention is not limited to the examples described but encompasses all variant executions thereof within the scope of the claims.

It is obvious, for example, that it is possible to change the injector nozzles for standard 3 mm outside diameter straws for nozzles for fine straws with a 2 mm outside diameter and a capacity of approximately 0.25 $cm^3$. The needle outside diameter for fine straws must be at most 1.4 mm for the needle to be able to enter the straw safely.

Nevertheless, the tube dimensions (outside diameter 4.5 mm and inside diameter 1.8 mm) can be retained to reduced the number of different parts where there is no need to do so because of the dimensions of the straws; the inside diameter of the hoop would be reduced to 3.6 mm, however.

The diameter of the interior passage 34*c* must be kept within relatively close limits. The volume of the internal passage, which is a dead space, increases in proportion to the square of the diameter. On the other hand, the viscosity of the dilute sperm imposes a minimum passage diameter to obtain ahead loss in the passage compatible with the vacuum pump and the required rate of filling.

There is claimed;

1. Single-use injector nozzle/ for machines for filling with biological products tubes usually called straws in the form of tubular sections of polymer material provided internally near one end with a composite stopper comprising between two porous plugs a volume of powder which gelifies when coming in contact with an aqueous liquid, wherein the filling being effected by gripping the straws between two nozzles fitted with seals bearing on the ends of the straw, namely a suction nozzle connected to a vacuum source and bearing on the end of the straw near the composite stopper wherein said injector nozzle fitted with a flexible tube which dips into a flask containing the biological product, said injector nozzle comprising a rigid needle adapted to be inserted into said straw and crimped axially into a body which has two external reference surfaces for respectively centering and longitudinally positioning said nozzle relative to a nozzle support, said flexible tube being made from an elastomer having a Shore hardness between 41 and 47 and a reversible elongation capacity of at least 250%, having an inside diameter of the same order of magnitude of the outside diameter of said needle and a nominal outside diameter at least twice said inside diameter, a right cross-section at the end into which said needle is inserted to a length of at least five times said needle outside diameter forming a seal bearing surface for the end of said straw remote from said composite stopper, and said flexible tube being gripped, at least when said nozzle is mounted on said machine, over a distance equal to at least five times its nominal outside diameter starting from the right cross-section at said end in a tubular hoop of rigid material whose inside diameter is matched to the nominal outside diameter of the tube with sufficient clamping force to hold and seal said needle, said hoop comprising said two reference surfaces.

2. Injector nozzle according to claim 1 wherein said needle projects from said right cross-section at said end of said flexible tube over a sufficient length to form at the end of said straw where said needle enters an unfilled area available for closing said straw by welding its wall.

3. Injector nozzle according to claim 1 wherein said needle has a bevel cut at the free end projecting from said flexible tube.

4. Injector nozzle according to claim 1 wherein said needle has an outside diameter of approximately 2.0 mm or approximately 1.4 mm depending on whether it is intended for standard straws with an outside diameter of 3 mm or fine straws with an outside diameter of 2 mm.

5. Injector nozzle according to claim 1 wherein the nominal diameter of said flexible tube is 4.5 mm.

6. Injector nozzle according to claim 1 wherein said elastomer of said flexible tube is a biologically compatible styrene and butadiene block copolymer.

7. Injector nozzle according to claim 1 wherein said needle is held in an extruded tube of PETG type polyester copolymer.

8. Injector nozzle according to claim 1 wherein said flexible tube has at the end remote from said needle a section of rigid tube inserted into its interior passage at one end and bevel cut at its other end.

9. Injector nozzle according to claim 1 wherein said hoop comprises a front part shaped to facilitate handling with a first overall dimension and an externally cylindrical rear part having a diameter less than the overall diameter of said front part and merging therewith through a radial shoulder perpendicular to the hoop axis.

10. Injector nozzle according to claim 1 wherein said hoop is permanently mounted on said flexible tube.

11. Injector nozzle according to claim 10 wherein said hoop is molded from a polymer material.

12. Injector nozzle according to claim 11 wherein said hoop is formed by overmolding.

13. Injector nozzle according to claim 11 wherein said hoop is formed in two shells adapted to fit together on a plane passing through its axis.

* * * * *